US006566812B1

(12) United States Patent
Torisaki et al.

(10) Patent No.: US 6,566,812 B1
(45) Date of Patent: May 20, 2003

(54) PLASMA DISPLAY PANEL

(75) Inventors: Yasuhiro Torisaki, Yamanashi-ken (JP); Kimio Amemiya, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 211 days.

(21) Appl. No.: 09/680,209

(22) Filed: Oct. 6, 2000

(30) Foreign Application Priority Data

Oct. 27, 1999 (JP) ..... 11-305791

(51) Int. Cl.[7] ..... H01J 17/49
(52) U.S. Cl. ..... 313/586; 313/585; 313/495
(58) Field of Search ..... 313/581–587, 313/495

(56) References Cited

U.S. PATENT DOCUMENTS 5,136,207 A * 8/1992 Miyake et al. ..... 313/582
5,742,122 A * 4/1998 Amemiya et al. ..... 313/582
5,763,139 A * 6/1998 Matsunaga et al. ..... 430/313
5,896,001 A * 4/1999 Shishido ..... 313/461
6,008,582 A * 12/1999 Asano et al. ..... 313/582
6,097,149 A * 8/2000 Miyaji et al. ..... 313/582
6,249,264 B1 * 6/2001 Sano et al. ..... 345/60
6,344,715 B2 * 2/2002 Tokunaga et al. ..... 315/169.4
6,348,762 B1 * 2/2002 Nunomura et al. ..... 313/582
6,411,032 B1 * 6/2002 Shiiki et al. ..... 313/582
6,411,033 B1 * 6/2002 Mori et al. ..... 313/582
6,498,430 B1 * 12/2002 Sakai et al. ..... 313/582

* cited by examiner

*Primary Examiner*—Robert H. Kim
*Assistant Examiner*—Jurie Yun
(74) *Attorney, Agent, or Firm*—Arent Fox Kintner Plotkin & Kahn

(57) ABSTRACT

A plasma display panel is provided with discharge cells CB, CG, CR at intersecting positions of row electrode pairs (X, Y) formed on a front glass substrate 10 and column electrodes D formed on a back glass substrate 13, and formed with phosphor layers 16B, 16G, 16R of the three primary colors of red, green and blue in the discharge cells CB, CG, CR in order. In such plasma display panel, the discharge cell CR formed with a red phosphor layer 16R, the discharge cell CG formed with a green phosphor layer 16G and the discharge cell CB formed with a blue phosphor layer 16B respectively have opening areas SB, SG, SR opening toward the front glass substrate 10, which are set to be increased with decreasing order of luminance in accordance with each luminance of red, green and blue colors.

8 Claims, 12 Drawing Sheets

V 1 – V 1

V 2 – V 2

V 3 – V 3

V 4 – V 4

W1 – W1

W2 – W2

V 5 – V 5

V 6 – V 6

W3 – W3

W4 – W4

PLASMA DISPLAY PANEL

BACKGROUND OF THE INVENTION

1. Field of the Invention

The invention relates to a plane discharge scheme AC type plasma display panel, and more particularly, to a cell structure of a plasma display panel for adjusting white balance.

2. Described of the Related Art

Recent years, a plasma display panel (referred to "PDP" hereinafter) of a plane discharge scheme AC type as an oversize and slim display for color screen has been received attention, which is becoming widely available.

FIG. 18 is a perspective view illustrating a configuration of a conventional AC type PDP when a front glass substrate 1 is separated from a back glass substrate 4.

In FIG. 18, a plurality of row electrode pairs (X', Y') is arranged on the backside of the front glass substrate 1 and covered with a transparent dielectric layer 2 on a backside of which a transparent protective layer 3 made of MgO is formed.

The row electrodes X' and Y' are respectively comprised of wider transparent electrodes Xa' and Ya' each of which is formed of a transparent conductive film made of ITO (Indium Tin Oxide) or the like, and narrower bus electrodes Xb' and Yb' each of which is formed of a metal film, complementary to conductivity of the transparent electrode. The row electrodes X' and Y' are provided with respective projections Xa" and Ya" which are formed opposite to each other spaced at regular intervals, and alternating in the column direction such that the projections Xa" and Ya" oppose each other with a discharge gap g' in between.

Each row electrode pair (X', Y') forms a display line (row) of matrix display.

A plurality of column electrodes D' is arranged on the display surface side of the back glass substrate 4 to extend in a direction perpendicular to the row electrode pair (X', Y'). A band-shaped partition wall 5 is interposed each between the column electrodes D' to extend in parallel to other partition walls 5. And also, phosphor layers 6R, 6G and 6B in red (R), green (G) and blue (B), respectively, which comprise the three primary colors, are formed in order in the column direction to overlay side faces of the partition walls 5 and the column electrode D'.

The front glass substrate 1 and the back glass substrate 4 having the above configuration are disposed in parallel and opposite to each other with an interposition of a discharge space. A discharge gas of a mixture of neon and xenon or the like is filled hermetically between the front glass substrate 1 and the back glass substrate 4.

In this manner, in each display line L, the discharge space is defined by the partition walls 5 at intersections of the column electrodes D' and the row electrode pair (X', Y'). This results in defining each discharge cell which serves as a unit light emitting area as described below.

An image is formed in the above AC type PDP as follows.

First, through address operation, the discharge is produced selectively between the row electrode pair (X', Y') and the column electrodes D' in the discharge cells respectively formed with the phosphor layers 6R, 6G and 6B, to scatter lighted cells (the discharge cells are formed with wall charge on the dielectric layer 2) and nonlighted cells (the discharge cells are not formed with wall charge on the dielectric layer 2), over the panel in response to an image to be displayed.

After the address operation, in all the display lines L, the discharge sustain pulse is applied alternately to the row electrode pairs (X', Y') in unison, and thus the plane discharge is produced in the lighted cells on every application of the discharge sustain pulse.

In this manner, the plane discharge in each lighted cell generates ultraviolet light, to excite the phosphor layers 6R and/or 6G and/or 6B formed in the lighted cell to emit light, resulting in displaying the image.

The aforementioned AC type PDP has outstanding properties to reduce thickness of a display and provide a color screen display with a high quality image.

In the conventional AC type PDP as explained above, the phosphor layers 6R, 6G and 6B formed in the respective discharge cells for displaying the three primary colors of red (R), green (G) and blue (B), differs in brightness of emission from one another. Therefore, if the discharge is produced in the discharge cells of respective colors having an equal emission area at the same number of times of the discharge, the display of a white color is difficult.

Therefore, conventionally, white balance (chromaticity of a white color) is adjusted by balancing the luminance of the three primary colors while the number of times of the discharge in each discharge cell is adjusted for each color on the phosphor layer.

However, the conventional method of adjusting the white balance as explained above has disadvantages in which a display gradation varies in each color, and also the number of display gradation levels itself is impaired. In addition, adjusting a display gradation of green having the largest influence over the luminance on screen, causes a disadvantage of reduction in the peak luminance on screen.

For example, if the number of times of the discharge in the discharge cells respectively formed with the phosphor layers 6R and 6G is reduced with respect to the number of times of the discharge in the discharge cell formed with the phosphor layer 6B, the discharge cell of the phosphor layer 6B can display up to 256 gradation level of the maximum luminance, but the emission luminance in the discharge cells of the phosphor layers 6R and 6G is achieved only by gradations lower than 256 gradation level.

As described above, if the adjustment of white balance is performed by adjusting the number of times of the discharge in each discharge cell for each color of the phosphor layer, the display gradations caused by light emission in the discharge cell vary for each color of red, green and blue, resulting in impairment of quality of gradation display.

SUMMARY OF THE INVENTION

The present invention has been made to solve the above problems associated with adjustment of white balance in the conventional AC type PDP as described above.

It is therefore an object of the present invention to provide a Plasma display panel which is capable of appropriately adjusting white balance without reducing each gradation level of the three primary colors of red, green and blue.

To attain the above object, a plasma display panel according to a first invention comprises a plurality of row electrode Pairs extending on a backside of a front substrate in a row direction and arranged thereon in a column direction to form display lines; a plurality of column electrodes extending in the column direction and arranged in the row direction on a face of a back substrate which opposites to the front substrate with interposing a space and constituting a discharge cell at each intersecting position with the row electrode pair in the space formed by the back substrate and the front substrate; and phosphor layers of the three primary colors of red, green and blue, respectively, which are respectively formed in a plurality of the resulting discharge cells in order, which is characterized in that the discharge cell formed with the red phosphor layer, the discharge cell formed with the green phosphor layer and the discharge cell formed with the blue phosphor layer, have a different opening area, opened toward the front substrate, from one another in accordance with each luminance of red, green and blue colors.

The plasma display panel according to the first invention is set such that an area ratio among the opening areas of the respective discharge cells relates with a predetermined relative ratio of luminance of blue, green and red.

According to the first invention, it is possible to adjust a relative emission luminance among the discharge cells during light emission by the plane discharge required for adjustment of white balance, only through controlling the opening area ratio among the discharge cells.

In consequence, as compared with the conventional method of adjusting the number of times of the discharge to the phosphor layer of each color for adjustment of white balance, since the discharge cell having a higher luminance of the phosphor layer is used as the reference, it is not required to increase the number of times of the discharge in the discharge cell having a lower luminance of the phosphor layer, so that the discharge current is not increased for the adjustment of white balance.

In the other way, since the discharge cell having a lower luminance of the phosphor layer is used as the reference, it is not required to decrease the number of times of the discharge in the discharge cell having a higher luminance of the phosphor layer, so that there may be no reduction in luminance on the screen in associated with the adjustment of white balance.

Since the display gradation of each color of the three primary colors becomes stable, the display gradation levels cannot be impaired, resulting in improvement in quality of display screen.

Moreover, since signal conditioning is not needed to adjust the number of times of the discharge in each discharge cell, the driving circuit configuration of PDP can be simple.

To attain the aforementioned object, the plasma display panel according to a second invention, in addition to the configuration of the first invention, is characterized by a part it ion wall including vertical wall port ions arranged between the front substrate and the back substrate to extend in the column direction and transverse wall portions arranged between the front substrate and the back substrate to extend in the row direction, to partition the space between the front substrate and the back substrate into the discharge cells in the row direction and the column direction, in which each of the transverse wall portions of the partition wall defining the discharge cell formed with the red phosphor layer, the discharge cell formed with the green phosphor layer and the discharge cell formed with the blue phosphor layer is varied in width in the column direction in accordance with each luminance of red, green and blue colors, to set the opening area of a front face of the each discharge cell opposing the front substrate.

The plasma display panel according to the second invention is set such that the discharge cells is partitioned by the rectangle shaped partition wall located between the front substrate and the back substrate, and each of the traverse walls of the partition wall partitioning the discharge cells in the column direction has a width in the column direction in accordance with luminance of the color of the phosphor layer in the discharge cell partitioned by the transverse walls. For this reason, each opening area of the discharge cells opening toward the front substrate relates to a predetermined relative luminance ratio among red, green and blue.

Hence, it is possible to provide a plasma display panel capable of properly adjusting white balance without reducing each gradation level of the three primary colors of red, green and blue.

To attain the aforementioned object, the plasma display panel according to a third invention, in addition to the configuration of the second invention, is characterized by comprising a dielectric layer formed on a backside of the front substrate to overlay the row electrode pairs, and formed with additional portions at portions thereof facing the transverse wall portions of the partition wall to jut out toward the transverse wall portions, wherein the additional portion is set to vary in width in the column direction in accordance with the width of the transverse wall portion of the partition wall facing the additional portion in the column direction.

In the plasma display panel according to the third invention, the additional portions formed in the dielectric layer to face the rectangle shaped partition wall and the transverse walls of the partition wall, divide the space between the front substrate and the back substrate into the discharge cells for each color of the phosphor layers.

Each width of the transverse wall of the partition wall and the additional portion of the dielectric layer facing the transverse wall is set in the column direction in accordance with luminance of the colors of the phosphor layers in the divided discharge cells. This determines the opening area of the discharge cell opening toward the front substrate in accordance with a predetermined relative luminance ratio of the three primary colors of red, green and blue. In consequence, it is possible to properly adjust white balance without the reduction of each gradation level of the three primary colors of red, green and blue.

To attain the aforementioned object, the plasma display panel according to a fourth invention, in addition to the configuration of the first invention, is characterized by including band-shaped partition walls located between the front substrate and the back substrate to extend in the column direction and be arranged in parallel in the row direction for partition of the discharge cells, in which any one of the partition walls is set to have a larger width than those of the remaining partition walls in the row direction to set the opening area of the each discharge cell on the side closer to the front substrate.

In the plasma display panel according to the fourth invention, the band shaped partition walls extending in the column direction partition the space between the front substrate and the back substrate into the discharge cells. At least one of the band shaped partition walls has a larger width in the row direction than those of the remaining partition walls to adjust an area ratio among the opening areas of the respective discharge cells in accordance with a predetermined luminance ratio among blue, green and red.

According to the fourth invention, it is possible to, only through controlling the opening area ratio among the discharge cells, perform the adjustment of a relative emission luminance among the discharge cells during light emission by the plane discharge which is required for adjustment of white balance.

In consequence, as compared with the conventional method of adjusting the number of times of the discharge to the phosphor layer of each color for adjustment of while balance, since the discharge cell having a higher luminance of the phosphor layer is used as the reference, it is not required to increase the number of times of the discharge in the discharge cell having a lower luminance of the phosphor layer, so that the discharge current is not increased for the adjustment of white balance.

In the other way, since the discharge cell having a lower luminance of the phosphor layer is used as the reference, it is not required to decrease the number of time discharge in the discharge cell having a higher luminance of the phosphor layer, so that there may be no reduction in luminance on the screen associated with the adjustment of white balance.

Since the display gradation of each color of the three primary colors becomes stable, the display gradation levels cannot be impaired, resulting in improvement of quality of display screen.

Moreover, since signal conditioning is not needed to adjust the number of times of the discharge in each discharge cell, the driving circuit configuration of PDP can be simple.

The plasma display panel according to a fifth invention is characterized by additional portions formed on positions of the dielectric layer facing the transverse wall portions to jut out toward the transverse wall portions not to form spaces between the additional portion and the transverse wall portions, and spaces are formed between the additional portion and the vertical wall portions of the partition wall.

According to the fifth invention, it is possible to prevent occurrence of improper discharge produced by interference between discharges of the discharge cells adjacent to each other in the column direction, resulting in high definition of screen.

The plasma display panel according to a sixth invention is characterized in that the phosphor layers are formed on side faces of the vertical wall port ions and the transverse wall portions of the partition wall and a front surface of the back substrate.

According to the sixth invention, the phosphor layer is formed on the five faces facing each discharge cell. This expands the surface area of the phosphor layers, or the light emitting area, as compared with conventional plasma display panels. Hence, with increase of luminance per discharge cell, it is possible to improve the luminance of the display screen much more than those of the conventional plasma display panels. In addition, as compared with the conventional plasma display panels, the luminance of the display screen is not decreased even if each discharge cell is reduced in size for enhancing definition of a screen.

The plasma display panel according to a seventh invention is characterized by a light absorption layer formed on a portion of the partition wall opposite to the front substrate.

According to the seventh invention, the light absorption layer formed on the partition wall absorbs ambient light incident from outside through the front substrate, to prevent reflection and improve contrast of the display screen.

The plasma display panel according to a eighth invention is characterized by a light absorption layer formed on a portion between bus electrodes of the row electrodes adjacent to each other in the two display lines.

According to the eighth invention, the light absorption layer formed between the bus electrodes of the row electrodes absorbs ambient light incident from outside through the front substrate, to prevent reflection and improve contrast of the display screen.

The plasma display panel according to a ninth invention is characterized in that each row electrode of the row electrode pair comprises a transparent electrode opposite to the other transparent with interposing a discharge gap in the each discharge cell, and a bus electrode connected to an end of the transparent electrode, locating distance from the discharge gap, in which the transparent electrode is formed in an independent island state in every discharge cell.

According to the ninth invention, since each transparent electrode constituting the row electrode pair is configured to be independent of the other transparent electrode in the island state in particular discharge cells, interference of discharges in the discharge cells adjacent to one another in the row direction may not occur even if the particular discharge cells are reduced in size for increasing the definition of the screen.

These and other objects and advantages of the present invention will become obvious to those skilled in the art upon review of the following description, the accompanying drawings and appended claims.

DETAILED DESCRIPTION OF THE PREFERRED EMBODIMENT

An embodiment deemed to be most amenable to description of the present invention will be described below in detail with reference to the accompanying drawings.

Figure 1:
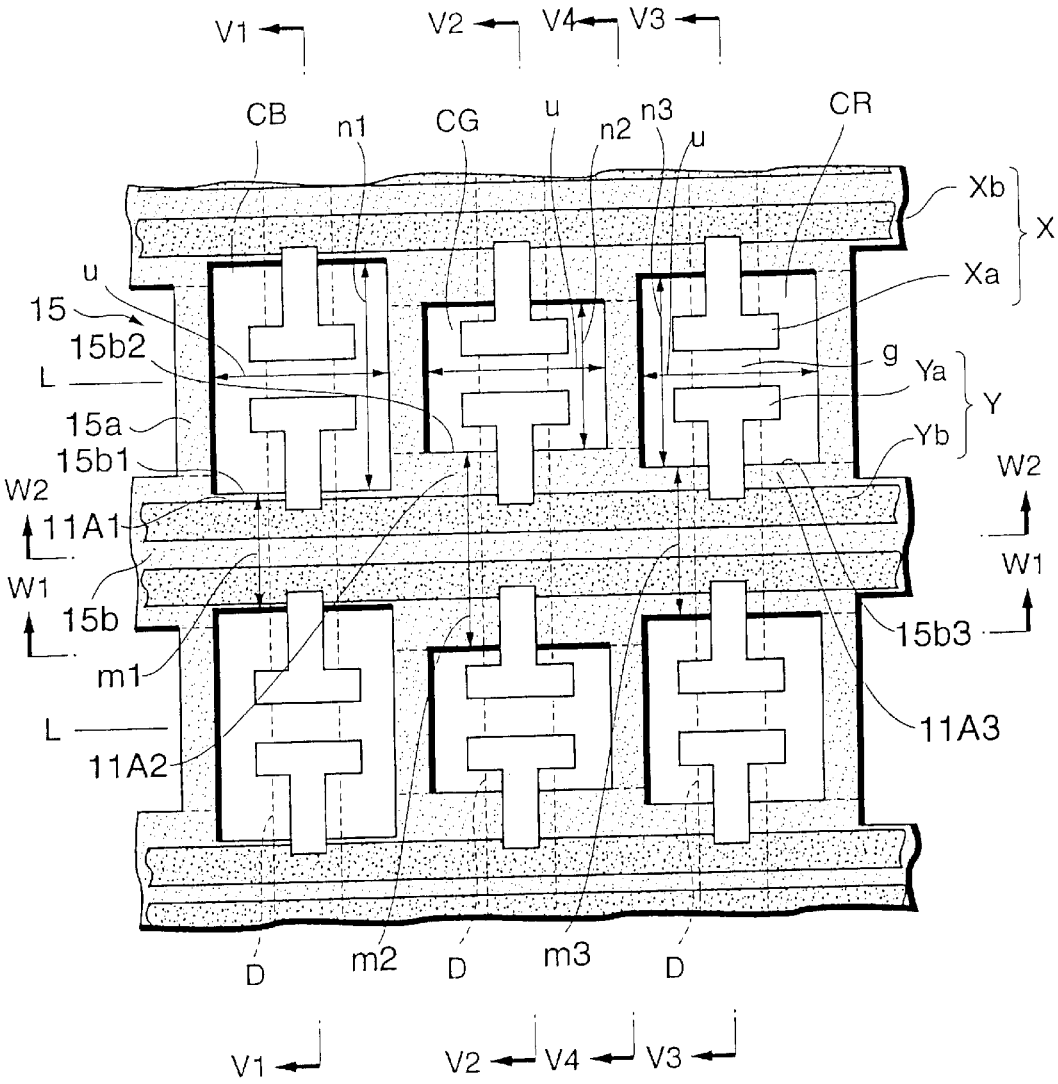
FIG. 1 is a plane view schematically showing a first example of an embodiment according to the present invention.
Figure 2:
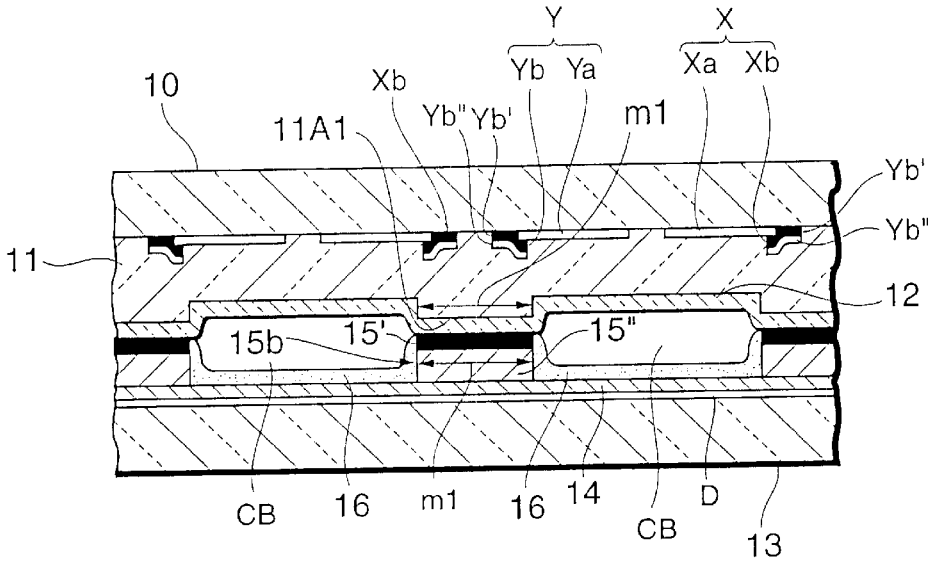
FIG. 2 is a sectional view taken along the V1—V1 line of FIG. 1.
Figure 3:
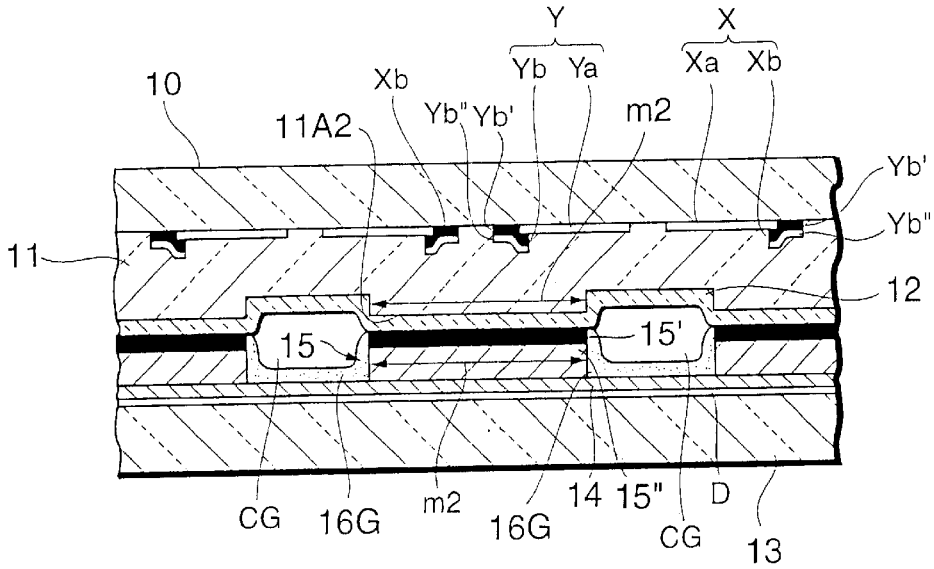
FIG. 3 is a sectional view taken along the V2—V2 line of FIG. 1.
Figure 4:
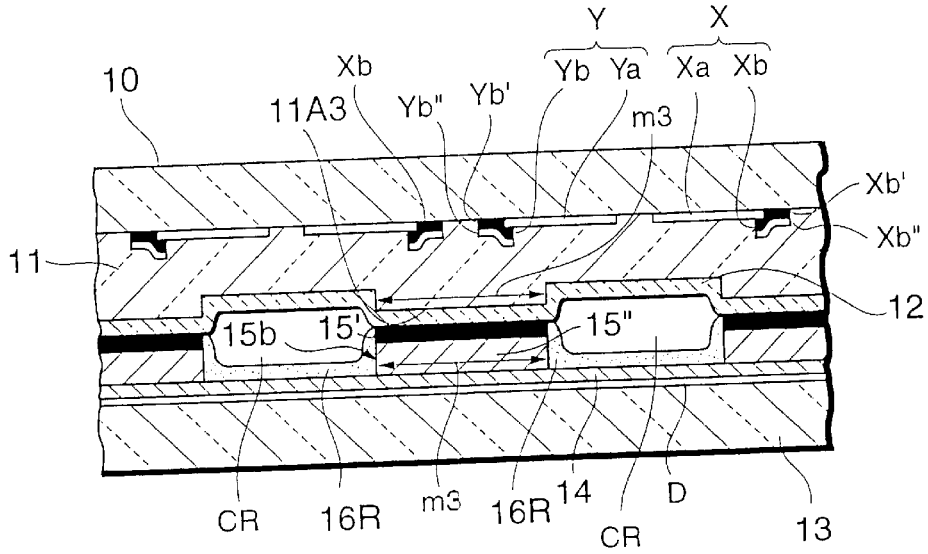
FIG. 4 is a sectional view taken along the V3—V3 line of FIG. 1.
Figure 5:
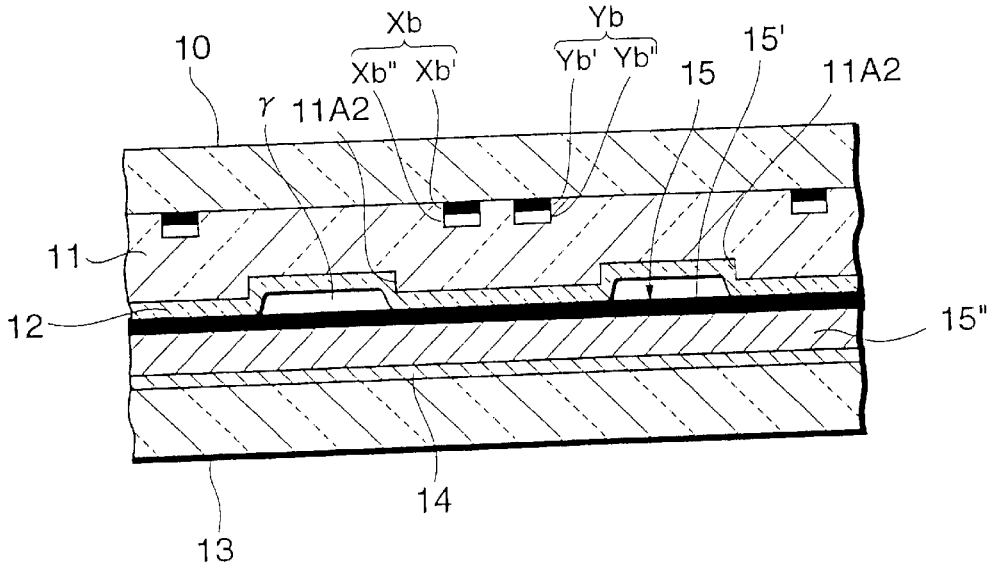
FIG. 5 is a sectional view taken along the V4—V4 line of FIG. 1.
Figure 6:
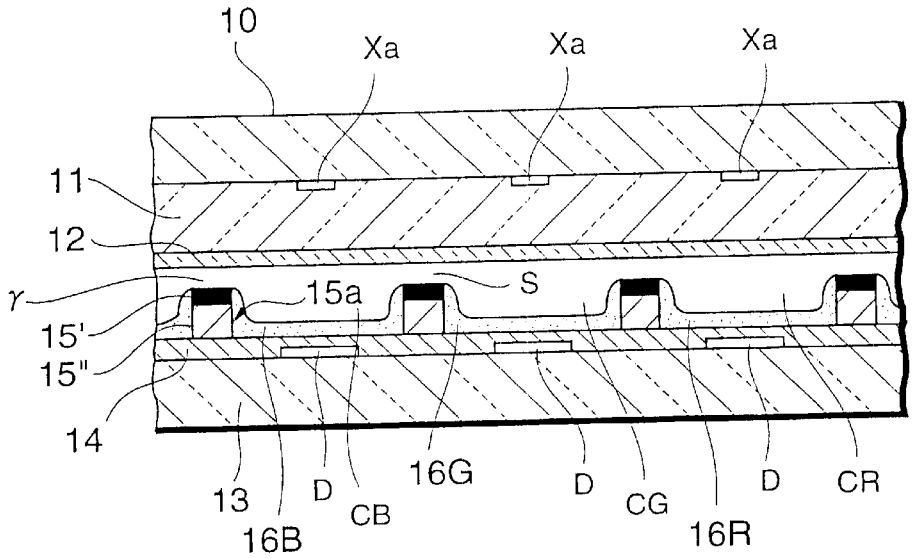
FIG. 6 is a sectional view taken along the W1—W1 line of FIG. 1.
Figure 7:
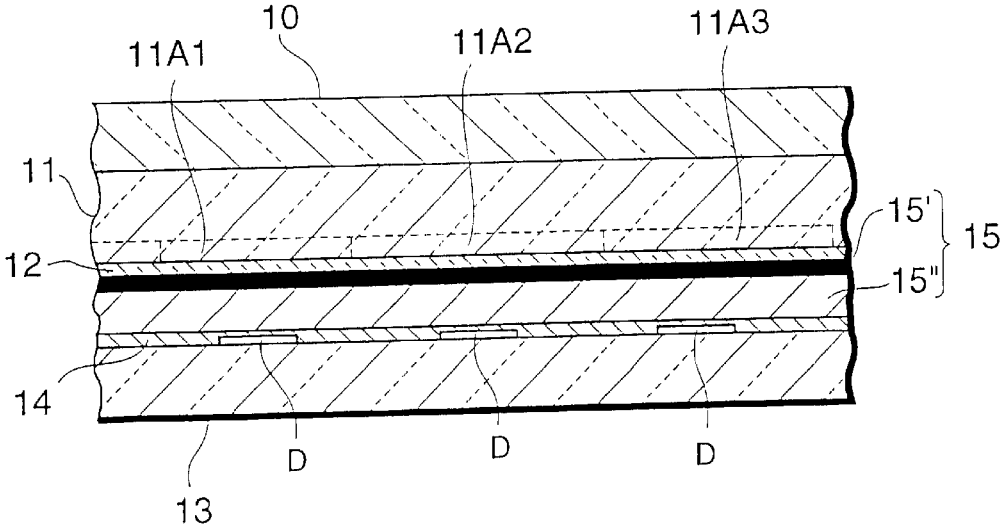
FIG. 7 is a sectional view taken along the W2—W2 line of FIG. 1.

FIGS. 1 to 7 illustrate a first example of the embodiment of a plasma display panel (referred as "PDP" hereinafter) according to the present invention. FIG. 1 is a plane view schematically presenting the relationship between a row electrode pair and a partition wall of PDP. FIG. 2 is a sectional view taken along the V1—V1 line of FIG. 1, FIG. 3 is a sectional view taken along the V2—V2 line of FIG. 1, FIG. 4 is a sectional view taken along the V3—V3 line of FIG. 1, FIG. 5 is a sectional view taken along the V4—V4 line of FIG. 1, FIG. 6 is a sectional view taken along the W1—W1 line of FIG. 1, and FIG. 7 is a sectional view taken along the W2—W2 line of FIG. 1.

Figure 18:
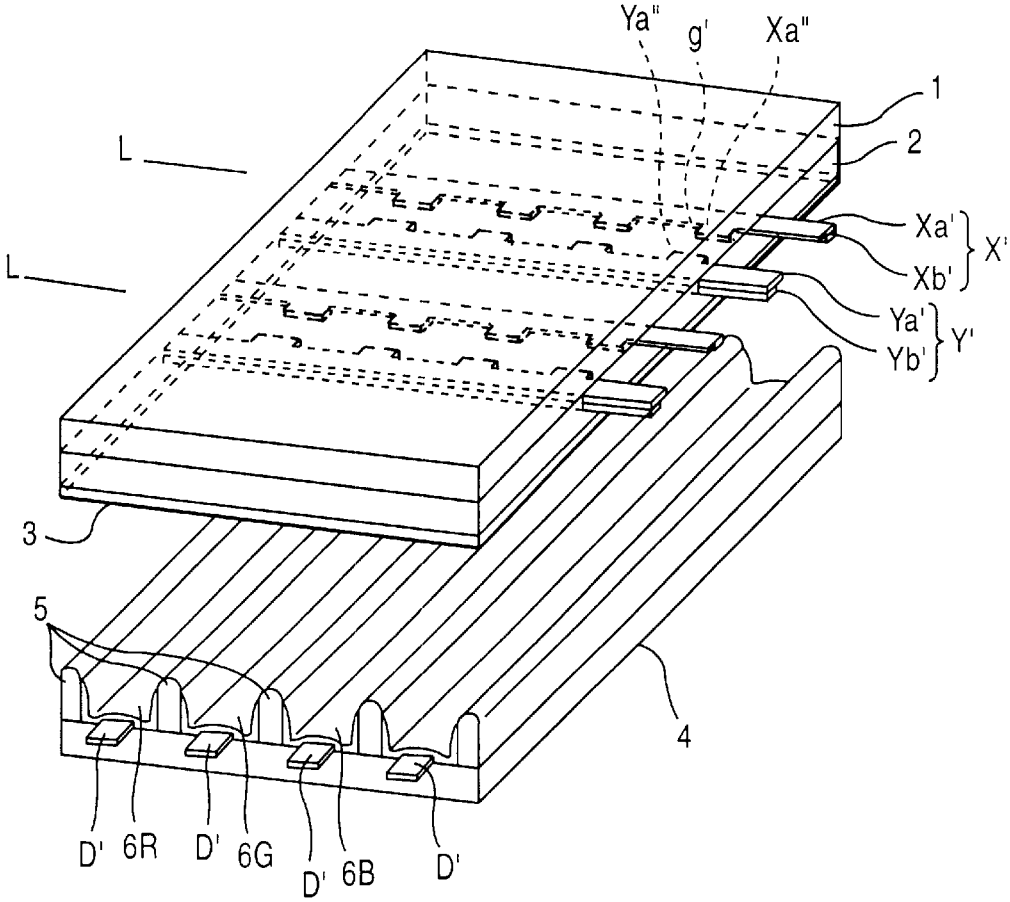
FIG.18 PRIOR ART
FIG. 18 is a plane view schematically showing a conventional cell structure of a plane discharge scheme AC type plasma display panel.

The PDP illustrated in FIGS. 1 through 7 is a plane discharge type PDP of an AC driving scheme, referred as a reflective type in which a phosphor layer is formed on a back glass substrate as in a conventional PDP shown in FIG. 18.

From FIG. 1 to FIG. 7, on the underside of a front glass substrate 10 which is the display surface, a plurality of row electrode pairs (X, Y) are arranged in parallel to extend in the row direction (in the traverse direction in FIG. 1) of the front glass substrate 10.

The row electrode X is composed of a T-shaped transparent electrode Xa formed of a transparent conductive film made of ITO (Indium Tin Oxide) or the like, and a bus electrode Xb formed of a metal film which extends in the row direction of the front glass substrate 10 and is connected to the base end having a smaller width of the transparent electrode Xa.

Similarly, the row electrode Y is composed of a T-shaped transparent electrode Ya formed of a transparent conductive film made of ITO (Indium Tin Oxide) or the like, and a bus electrode Yb formed of a metal film which extends in the row direction of the front glass substrate 10 and is connected to the base end having a smaller width of the transparent electrode Ya.

The row electrodes X and Y are alternated in the column direction (the vertical direction of FIG. 1) of the front glass substrate 10. The transparent electrodes Xa and Ya aligned along the bus electrodes Xb and Yb respectively extend toward the other row electrode of the pair, and the top edges having a larger width of the transparent electrodes Xa and Ya face each other with a discharge gap g having a predetermined width in between.

Each of the bus electrodes Xb and Yb is configured to be a double layer structure with a black conductive layer Xb' or Yb' formed near the display surface and a main conductive layer Xb" or Yb" formed near the back surface.

A dielectric layer 11 is further formed on the backside of the front glass substrate 10 to overlay the row electrode pair (X, Y).

Furthermore, on the backside of the dielectric layer 11 and at a position facing the back-to-back oriented bus electrodes Xb and Yb of the adjacent row electrode pairs (X, Y), a dielectric layer 11A1 having a width m1 in the column direction (in the vertical direction of FIG. 1) as shown in FIG. 2; a dielectric layer 11A2 having a width m2 in the column direction as shown in FIG. 3; and a dielectric layer 11A3 having a width m3 in the column direction shown in FIG. 4, are formed repeatedly in order from the left side of FIG. 1, to extend in a parallel direction (the row direction) to the bus electrodes Xb and Yb.

A relationship among the additional dielectric layers 11A1, 11A2 and 11A3 is set to be m2>m3>m1 in width.

On the backsides of the dielectric layer 11 and the additional dielectric layers 11A1, 11A2 and 11A3, a protective layer 12 made of MgO is formed.

On the other hand, on the front face, oriented toward the display surface, of the back glass substrate 13 located in parallel to the front glass substrate 10, column electrodes D are arranged in parallel to each other at predetermined spaced intervals to extend at positions opposite to the transparent electrodes Xa and Ya, pairing up with each other, of each row electrode pair (X, Y) in a direction perpendicular to the row electrode pairs (X, Y) (in the column direction).

On the front face of the back glass substrate 13 oriented toward the display surface, a white dielectric layer 14 is further formed to overlay the column electrodes D, and a partition wall 15 are formed on the dielectric layer 14.

The partition wall 15 is formed in a parallel-crossed shape (i.e. a box shape) with vertical walls 15*a* extending between the column electrodes D arranged in parallel to one another in the column direction, and transverse walls 15*b* extending at positions acing the additional dielectric layers 11A1, 11A2 and 11A3 in the row direction.

The transverse walls 15*b* are formed such that a portion 15*b*1 facing the additional dielectric layer 11A1 has the same width m1 as that of the additional dielectric layer 11A1; a portion 15*b*2 facing the additional dielectric layer 11A2 has the same width m2 as that of the additional dielectric layer 11A2; and a portion 15*b*3 facing the additional dielectric layer 11A3 has the same width m3 as that of the additional dielectric layer 11A3.

By the parallel-cross-shaped (box-shaped) partition wall 15, a space between the front glass substrate 10 and the back glass substrate 13 is defined for each p art opposite to the paired transparent electrodes Xa and Ya of each row electrode pair (X, Y), to form quadrangle discharge cells CB, CG and CR in order from the left side of FIG. 1.

All the discharge cells CB, CG and CR are set to have the same width u in the row direction. Regarding to a width n1 of the discharge cell CB in the column direction, a width n2 of the discharge cell CG in the column direction and a width n3 of the discharge cell CR in the column direction, a relationship of n1>n3>n2 is established by the reason of the aforementioned relationship m2>m3>m1 among the width m1, m2 and m3 of portions 15*b*1, 15*b*2 and 15*b*3 of the transverse wall 15*b* defining each discharge cell CB, CG, CR.

Therefore, an opening area SB of the discharge cells CB, an opening area SG of the discharge cells CG and an opening area SR of the discharge cells CR on the display surface of the front glass substrate 10 has a relationship of SB>SG>SR.

The partition wall 15 is formed in a two-layer structure with a black layer (a light absorption layer) 15' formed on the display surface side, and a white layer (a light reflection layer) 15" formed on the back surface side, which are configured to have each side wall face facing each inside of the discharge cells CB, CG and CR to be approximately white (i.e. a light reflection layer).

The face of the vertical wall 15*a* of the partition wall 15 which is near the display surface is not in contact with the protective layer 12 (see FIG. 6), and a space s is formed between the above face and the protective layer 12. On the other hand, the face of the transverse wall 15*b* on the display surface side is in contact with portions of the protective layer 12 which overlays the additional dielectric layers 11A1, 11A2 and 11A3 (see FIGS. 2 to 4 and FIG. 7), to shield each between the adjacent discharge cells CB, the adjacent discharge cells CG and the adjacent discharge cells CR in the column direction.

Each inside of the discharge cells CB, CG and CR are made up by five faces of the side faces of the vertical walls 15*a* and transverse walls 15*b* of the partition wall 15 and the front face of the dielectric layer 14. In the discharge cell CB, a blue phosphor layer 16B is formed on the five faces to overlay all of them; in the discharge cell CG, a green phosphor layer 16R is formed on the five faces to overlay all of them; and in the discharge cell, a red phosphor layer 16R is formed on the five faces to overlay all of them.

Each discharge cell CB,CG and CR is hermetically filled therein with a discharge gas of a mixture of neon and xenon or the like.

The above PDP is configured such that each row electrode pair (X, Y) comprises one display line (row) L on the matrix display screen, and the discharge cells CB, CG and CR adjacent to each other comprise a pixel.

The image display in the PDP is carried out as in the conventional PDP.

Specifically, first, through address operation, the discharge is produced selectively between the row electrode pair (X, Y) and the column electrodes D in each discharge cell CB,CG and CR, to scatter lighted cells (the discharge cells are formed with wall electric-charge on the dielectric layer 11) and nonlighted cells (the discharge cells are not formed with wall electric-charge on the dielectric layer 11), over the panel in response to an image to be displayed.

After the address operation, in all the display lines L, the discharge sustain pulse is applied alternately to the row electrode pairs (X, Y) in unison, and thus the plane discharge is produced in each lighted cell on every application of the discharge sustain pulse.

In this manner, the plane discharge in each lighted cell generates ultraviolet light, and the phosphor layers 16B, 16G, 16R in the particular discharge cells CB, CG and CR are selectively excited for light emission to decide color light-emitted from each pixel, resulting in forming the image to be displayed on the display surface.

As mentioned above, for the above PDP, the discharge cell CB formed with the blue phosphor layer 16B having the relatively lowest emission luminance, is formed to have the largest opening area SB; the discharge cell CR formed with the red phosphor layer 16R having a lower emission luminance, is formed to have a larger opening area SR; and the discharge cell CG formed with the green phosphor layer 16G having the relatively highest emission luminance, is formed to have the smallest opening area SG.

Therefore, if an area ratio among the opening areas SB, SG and SR of the respective discharge cells CB, CG and CR is set to relate with a predetermined relative ratio of luminance of blue, green and red, this raises the possibility to, only through controlling the opening area ratio among the discharge cells CB, CG and CR, perform the adjustment of a relative emission luminance among the discharge cells during light emission by the plane discharge which is required for adjustment of white balance.

The aforementioned opening area means a size of the discharge space defined by the partition wall of each discharge cell of each color. Hence, the fact that the area ratio among the opening areas SB, SG and SR of the respective discharge cells CB, CG and CR is set to relate with the predetermined relative ratio of luminance of blue, green and red, means that a size (volume) of each discharge space of the discharge cells CB, CG and CR is set to relate with the predetermined relative ratio of luminance of blue, green and red.

In consequence, as compared with the conventional method of adjusting the number of times of the discharge to the phosphor layer for each color for adjustment of white balance, since the discharge cell having a higher luminance of the phosphor layer is used as the reference, it is not required to increase the number of times of the discharge in the discharge cell having a lower luminance of the phosphor layer, so that the discharge current is not increased for the adjustment of white balance.

In the other way, since the discharge cell having a lower luminance of the phosphor layer is used as the reference, it is not required to decrease the number of times of the discharge in the discharge cell having a higher luminance of the phosphor layer, so that there may be no reduction in luminance on the screen in associated with the adjustment of white balance.

Since the display gradation of each color of the three primary colors becomes stable, the display gradation levels cannot be impaired, resulting in improvement in quality of display screen.

Moreover, since signal conditioning is not needed to adjust the number of times of the discharge in each discharge cell, the driving circuit configuration of PDP can be simple.

In addition, the above PDP is provided with the black layer 15' on the face of the partition wall 15 close to the display surface and the black conductive layers Xb' and Yb' in the respective bus electrodes Xb and Yb near the display surface. This enables to prevent reflection of outside light incident from outside through the front glass substrate 10, so as to efficiently suppress reflectance of the outside light incident on the display surface of the front glass substrate 10.

It should be noted that in the PDP of the aforementioned example, the width of the vertical wall 15*a* of the partition wall 15 is constant, and the width of the transverse wall 15*b* is varied to allow the opening areas SB, SG and SR of the respective discharge cells CB, CG and CR to differ in size from each other. To differ in size of the opening areas SB, SG and SR of the respective discharge cells CB, CG and CR from each other, the width of the vertical wall 15*a* may be varied.

Next, a second example in the embodiment of the present invention will be described with reference to FIG. 8.

Figure 8:
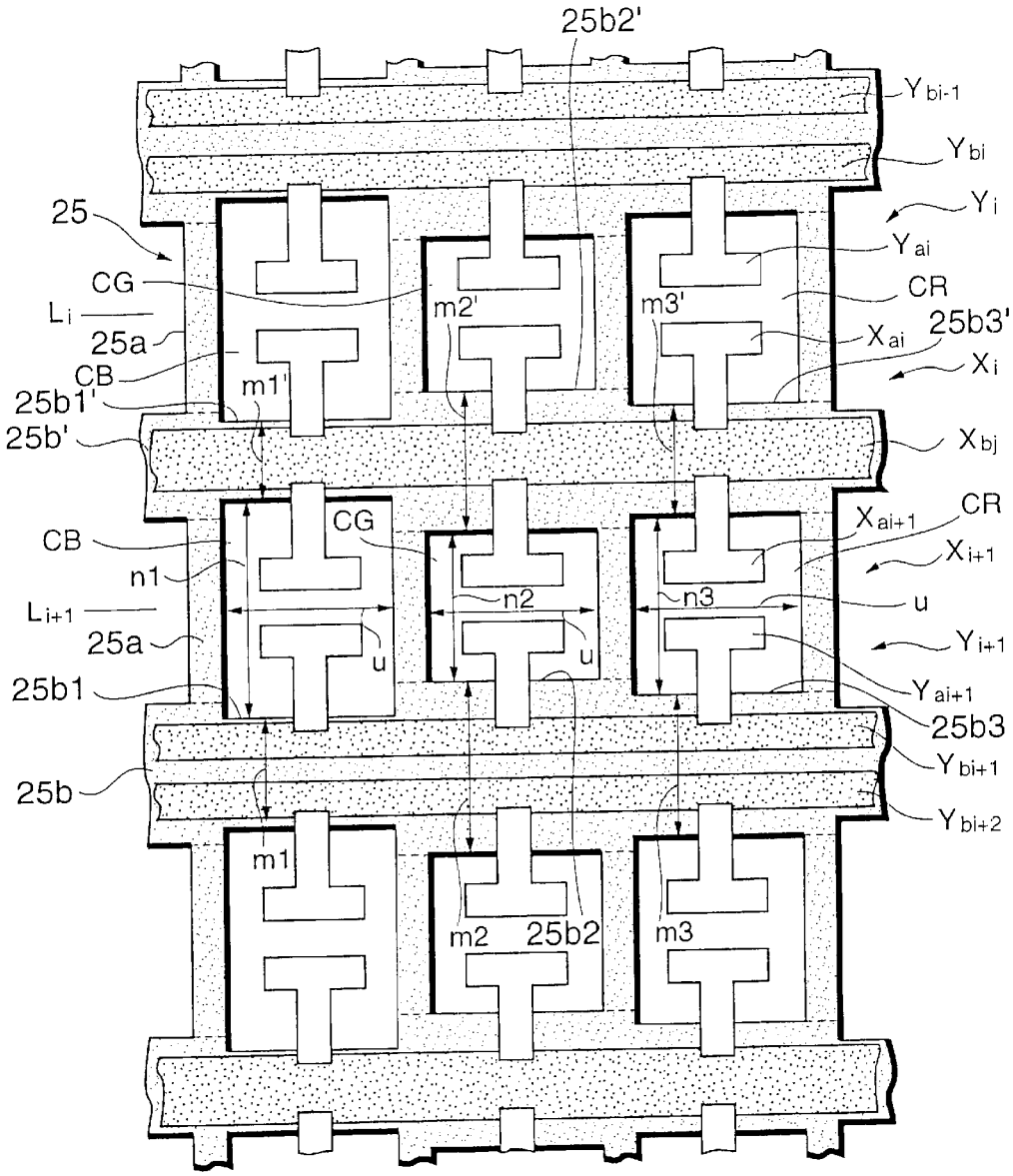
FIG. 8 is a plane view schematically showing a second example of an embodiment according to the present invention.

FIG. 8 is a plane view schematically showing the relationship between a row electrode pair and a partition wall of PDP in the second embodiment.

In the PDP in the first example illustrated in FIGS. 1 to 7, the row electrodes X and Y are alternated in the column direction. In the PDP in the second example, however, the seated positions of the row electrodes X and Y are replaced with each other for each display line. For example, in FIG. 8, the row electrode pairs (Yi, Xi) (Xi+1, Yi+1) are arranged in the corresponding display lines Li, Li+1 arranged in the column direction. And also, in the display lines Li and Li+1 adjacent to each other in the column direction, a common bus electrode Xbj is connected to the transparent electrodes Xai and Xai+1 of the back-to-back oriented row electrodes Xi and Xi+1 of the row electrode pairs (Yi, Xi) and (Xi+1, Yi+1).

As such, in the PDP of the second example, in the adjacent display lines, the back-to-back oriented row electrodes Xi and Xi+1 shares the use of the bus electrode Xbj, which in turn reduces an area for installing the bus electrode Xbj, compared with the first example. Accordingly, each volume of the discharge cells CB, CG and CR can be increased by the reduction in area of the bus electrode, to increase the surface area of each phosphor layer formed in the discharge cells CB, CG and CR, resulting in an increase in luminance on the display surface.

As in the PDP of the first example, the PDP of the second example is also set such that the opening areas SB, SG and SR of the respective discharge cells CB, CG and CR arranged in order from the left side of FIG. 8 along the display lines Li and Li+1, have a relationship SB>SG>SR.

Specifically, a parallel-cross shaped partition wall 25 is set such that a portion 25*b*1, defining the discharge cell CB, of a traverse wall 25*b* facing bus electrodes Ybi+1 and Ybi+2 of the respective row electrodes Yi+1 and Yi+2 oriented back to back in pair, has the same width m1 in the column direction (the vertical direction of FIG. 8) as that in the first example; a portion 25*b*2 defining the discharge cell CG has the width m2 in the column direction; and a portion 25*b*3 defining the discharge cell CB has the width m3 in the column direction.

The partition wall 25 is set such that a portion 25*b*1', defining the discharge cell CB, of the transverse wall 25*b*' facing the common bus electrode Xbj has a width m1'in the column direction which is smaller than the width m1 of the portion 25*b*1 of the transverse wall 25*b* by the reduction of the installation area of the bus electrode Xbj due to the common use. Similarly, a portion 25*b*2' defining the discharge cell CG has a width m2' in the column direction which is smaller than the width m2 of the portion 25*b*2 of the transverse wall 25*b*; and a portion 25*b*3' defining the discharge cell CB has a width m3' in the column direction which is smaller than the width m3 of the portion 25*b*3 of the transverse wall 25*b*.

Moreover, as in the first example, an additional dielectric layer is formed behind the dielectric layer on the backside of the front glass substrate. The additional dielectric layer has portions respectively facing to portions 25*b*1, 25*b*2 and 25*b*3 of the transverse wall 25*b* of the partition wall 25, which are set to have the same widths as the respective widths m1, m2 and m3 of the portions 25*b*1, 25*b*2 and 25*b*3. The additional dielectric layer also has portions respectively facing to portions 25*b*1', 25*b*2' and 25*b*3' of the transverse wall 25*b*', which are set to have the same widths as the respective widths m1', m2' and m3' of the portions 25*b*1', 25*b*2' and 25*b*3'.

As such, any width of each discharge cell CB, CG and CR in the row direction is set to be the same width u. Also, the widths m1, m2 and m3 of the respective portions 25*b*1, 25*b*2 and 25*b*3 of the transverse wall 25*b* defining the corresponding discharge cells CB, CG and CR, have a relationship m2>m3>m1, and the widths m1', m2' and m3' of the respective portions 25*b*1', 25*b*2'and 25*b*3' of the transverse wall 25*b*' have a relationship m2'>m3'>m1'.

Hence, a width n1 of the discharge cell CB in the column direction, a width n2 of the discharge cell CG in the column direction, and a width n3 of the discharge cell CR in the column direction have a relationship n1>n3>n2. Furthermore, an opening area SB of the discharge cells CB in the display surface of the front glass substrate 10, an opening area SG of the discharge cells CG and an opening area SR of the discharge cells CR have a relationship SB>SG>SR.

For the above PDP, as in the PDP of the first example, the discharge cell CB formed with a blue phosphor layer having the relatively lowest emission luminance, is formed to have the largest opening area SB; the discharge cell CR formed with a red phosphor layer having a lower emission luminance, is formed to have a larger opening area SR; and the discharge cell CG formed with a green phosphor layer having the relatively highest emission luminance, is formed to have the smallest opening area SG.

Therefore, if an area ratio among the opening areas SB, SG and SR of the respective discharge cells CB, CG and CR is set to relate with a predetermined relative ratio of luminance of blue, green and red, this raises the possibility to, only through controlling the opening area ratio among the discharge cells CB, CG and CR, perform the adjustment of a relative emission luminance among the discharge cells during light emission by the plane discharge which is required for adjustment of white balance.

In consequence, as compared with the conventional method of adjusting the number of times of the discharge to the phosphor layer of each color for adjustment of white balance, since the discharge cell having a higher luminance of the phosphor layer is used as the reference, it is not required to increase the number of times of the discharge in the discharge cell having a lower luminance of the phosphor layer, so that the discharge current is not increased for the adjustment of white balance.

In the other way, since the discharge cell having a lower luminance of the phosphor layer is used as the reference, it is not required to decrease the number of times of the discharge in the discharge cell having a higher luminance of the phosphor layer, so that there may be no reduction in luminance on the screen in associated with the adjustment of white balance.

Since the display gradation of each color of the three primary colors becomes stable, the display gradation levels cannot be impaired, resulting in improvement in quality of display screen.

Moreover, since signal conditioning is not needed to adjust the number of times of the discharge in each discharge cell, the driving circuit configuration of PDP can be simple.

It should be noted that in the PDP of the aforementioned example, the width of the vertical wall 25*a* of the partition wall 25 is constant, and the widths of the transverse walls 25*b* and 25*b*' are varied to allow the opening areas SB, SG and SR of the respective discharge cells CB, CG and CR to differ in size from each other. To differ in size of the opening areas SB, SG and SR of the respective discharge cells CB, CG and CR from each other, the width of the vertical wall 25*a* may also be varied.

Next, a third example of the embodiment of the present invention will be described with reference to FIG. 9.

Figure 9:
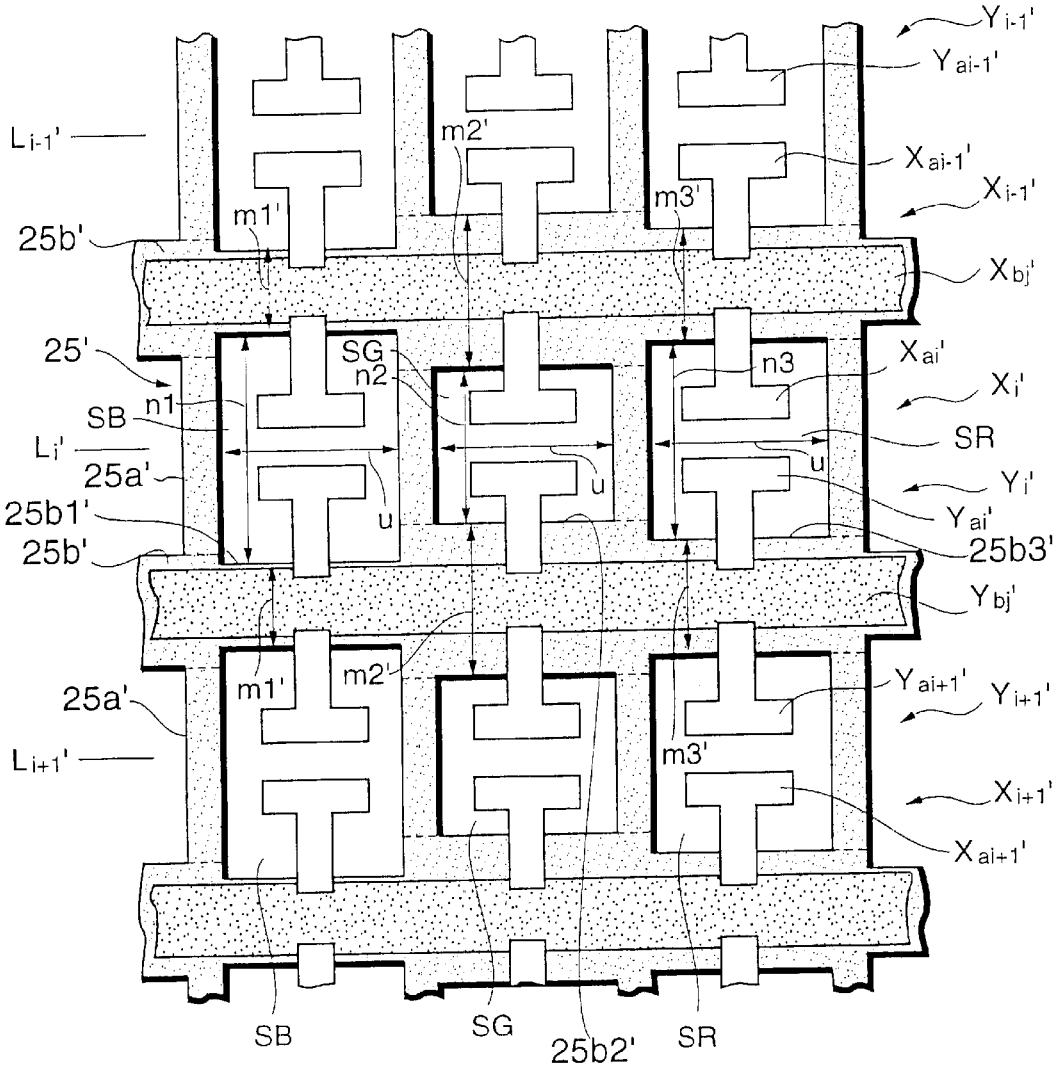
FIG. 9 is a plane view schematically showing a third example of an embodiment according to the present invention.

FIG. 9 is a plane view schematically showing a relationship between a row electrode pair and a partition wall of PDP in the third example.

In the PDP in the first example illustrated in FIGS. 1 to 7, the row electrodes X and Y are alternated in the column direction. In the PDP of the third example, however, the seated positions of the row electrodes X and Y are replaced with each other for each display line.

For example, referring to FIG. 9, the row electrode pairs (Yi−1', Xi−1') (Xi', Yi') are arranged in the corresponding display lines Li−1', Li', Li+1' arranged in the column direction. In addition, in the display lines Li−1', Li' and Li+1' adjacent to each other in the column direction, a common bus electrode Xbj is connected to the transparent electrodes Xai−1' and Xai' of the back-to-back oriented row electrodes Xi−1' and Xi' of the row electrode pairs (Yi−1', Xi−1') and (Xi', Yi') and a common bus electrode Ybj is connected to the transparent electrodes Yai' and Yai+1' of the back-to-back oriented row electrodes Yi'and Yi+1' of the row electrode pairs (Xi', Yi') and (Yi+1', Xi+1').

As such, in the PDP of the third example, in the adjacent display lines, the back-to-back oriented row electrode pairs Xi' and Yi' respectively share the use of the bus electrodes Xbj and Ybj, which in turn reduces an area for installing the bus electrodes Xbj and Ybj as compared with that in the first example. Accordingly, each volume of the discharge cells CB, CG and CR can be increased by the reduction of the installed area of the bus electrodes, to increase the surface area of each phosphor layer formed in the discharge cells CB, CG and CR, resulting in increase in luminance on the display surface.

As in the PDP of the first example, the PDP of the third example is also set such that the opening areas SB, SG and SR of the respective discharge cells CB, CG and CR arranged in order from the left side of FIG. 9 along the display lines Li and Li+1 have a relationship SB>SG>SR.

Specifically, a parallel-cross shaped partition wall 25' is designed such that a portion **25*b*1', defining the discharge cell CB, of a traverse wall 25*b*' facing common bus electrodes Xbj' and Ybj' has a width m1' in the column direction; a portion 25*b*2' defining the discharge cell CG has a width m2' in the column direction; and a portion 25*b*3' defining the discharge cell CB has a width m3'** in the column direction.

Moreover, as in the first example, an additional dielectric layer is formed behind the dielectric layer on the backside of the front glass substrate. The additional dielectric layer has portions respectively facing to portions **25*b*1', 25*b*2' and 25*b*3' of the transverse wall 25*b*' of the partition wall 25', which are set to have the same widths as the respective widths m1', m2' and m3' of the portions 25*b*1', 25*b*2' and 25*b*3'**.

As such, any width of each discharge cell CB, CG and CR in the row direction is set to be the same width u. Also, the widths m1', m2' and m3' of the respective portions **25*b*', 25*b*2' and 25*b*3' of the transverse wall 25*b*' defining the corresponding discharge cells CB, CG and CR, has a relationship m2'>m3'>m1'. Hence, a width n1 of the discharge cell CB in the column direction, a width n2 of the discharge cell CG in the column direction, and a width n3 of the discharge cell CR in the column direction have a relationship n1>n3>n2. Furthermore, an opening area SB of the discharge cells CB in the display surface of the front glass substrate 10**, an opening area SG of the discharge cells CG and an opening area SR of the discharge cells CR have a relationship SB>SG>SR.

For the above PDP, as in the PDP of the first example, the discharge cell CB formed with a blue phosphor layer having the relatively lowest emission luminance, is formed to have the largest opening area SB; the discharge cell CR formed with a red phosphor layer having a lower emission luminance, is formed to have a larger opening area SR; and the discharge cell CG formed with a green phosphor layer having the relatively highest emission luminance, is formed to have the smallest opening area SG.

Therefore, if an area ratio among the opening areas SB, SG and SR of the respective discharge cells CB, CG and CR is set to relate with a predetermined relative ratio of luminance of blue, green and red, this raises the possibility to, only through controlling the opening area ratio among the discharge cells CB, CG and CR, perform the adjustment of a relative emission luminance among the discharge cells during light emission by the plane discharge which is required for adjustment of white balance.

In consequence, as compared with the conventional method of adjusting the number of times of the discharge to the phosphor layer of each color for adjustment of white balance, since the discharge cell having a higher luminance of the phosphor layer is used as the reference, it is not required to increase the number of times of the discharge in the discharge cell having a lower luminance of the phosphor layer, so that the discharge current is not increased for the adjustment of white balance.

In the other way, since the discharge cell having a lower luminance of the phosphor layer is used as the reference, it is not required to decrease the number of times of the discharge in the discharge cell having a higher luminance of the phosphor layer, so that there may be no reduction in luminance on the screen associated with the adjustment of white balance.

Since the display gradation of each color of the three primary colors becomes stable, the display gradation levels cannot be impaired, resulting in improvement in quality of display screen.

Moreover, since signal conditioning is not needed to adjust the number of times of the discharge in each discharge cell, the driving circuit configuration of PDP can be simple.

It should be noted that in the PDP of the aforementioned example, the width of the vertical wall **25*a*' of the partition wall 25' is constant, and the widths of the transverse wall 25*b*' are varied to allow the opening areas SB, SG and SR of the respective discharge cells CB, CG and CR to differ in size from each other. To differ in size of the opening areas SB, SG and SR of the respective discharge cells CB, CG and CR from each other, the width of the vertical wall 25*a*'** may also be varied.

Figure 10:
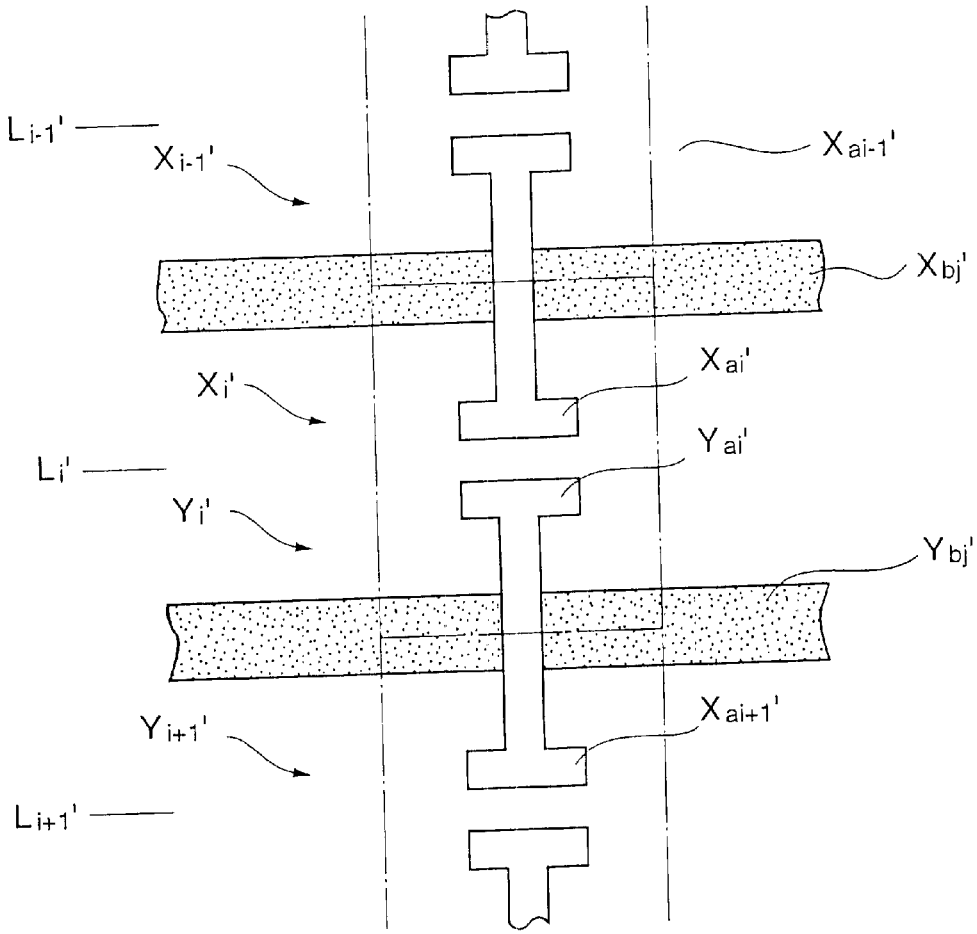
FIG. 10 is a plane view schematically showing a fourth example of an embodiment according to the present invention.

FIG. 10 illustrates a forth example of the embodiment of the invention. PDP in this example is a modification of the PDP in the third example of in FIG. 9.

Specifically, for the PDP of the fourth example, in the adjacent display lines of PDP in FIG. 9, transparent electrodes Xai−1' and Xai' of back-to-back oriented row electrodes Xi−1' and Xi' are coupled at the respective base ends to each other for integral formation, and transparent electrodes Yai' and Yai+1' of back-to-back oriented row electrodes Yi' and Yi+1' are coupled at the respective base ends to each other for integral formation. The remaining configuration is the same as that of the PDP in the third example and has the same function effects.

Next, a fifth example of the embodiment of the present invention will be described with reference to FIGS. 11 to 15.

Figure 11:
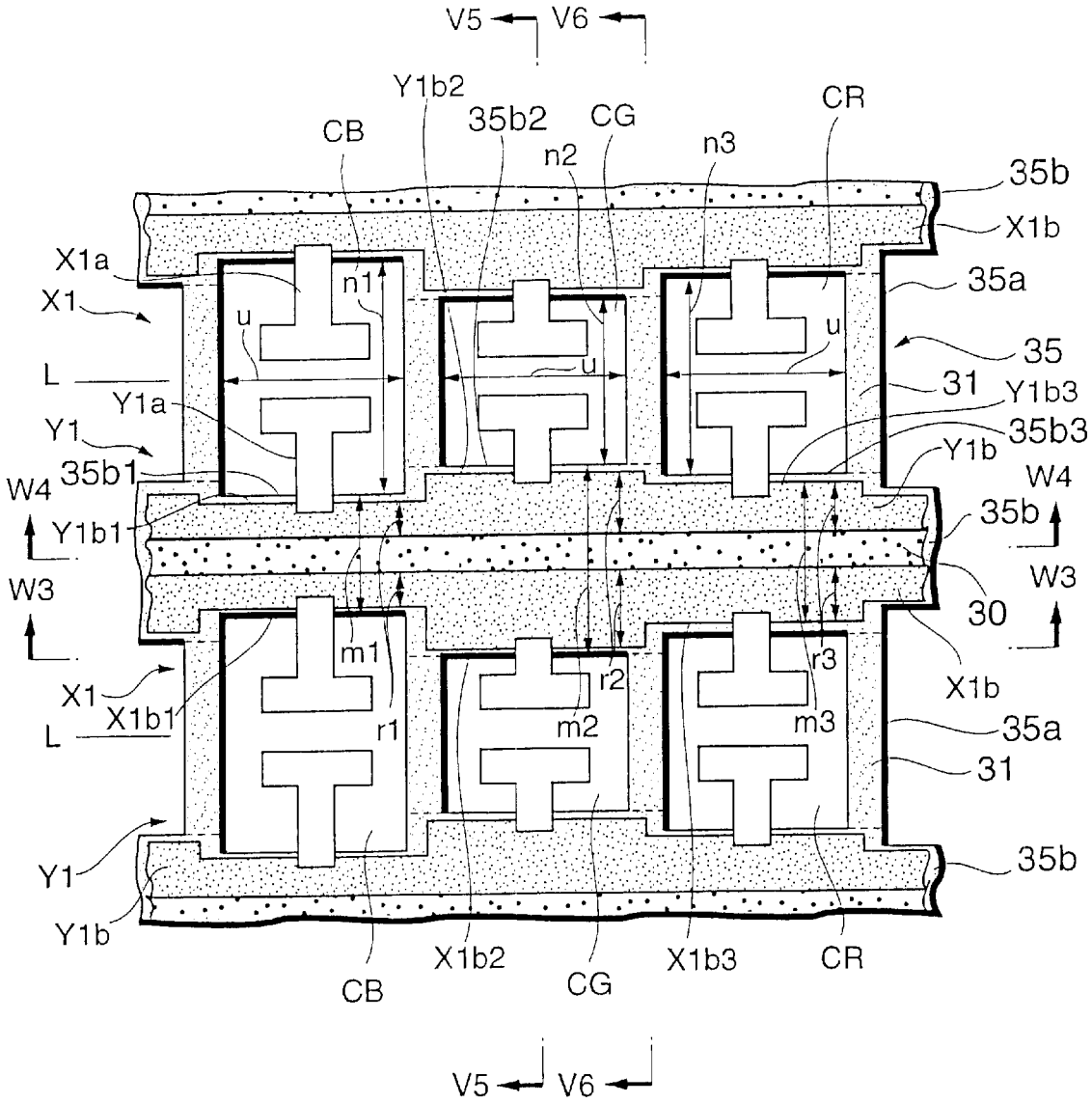
FIG. 11 is a plane view schematically showing a fifth example of an embodiment according to the present invention.
Figure 12:
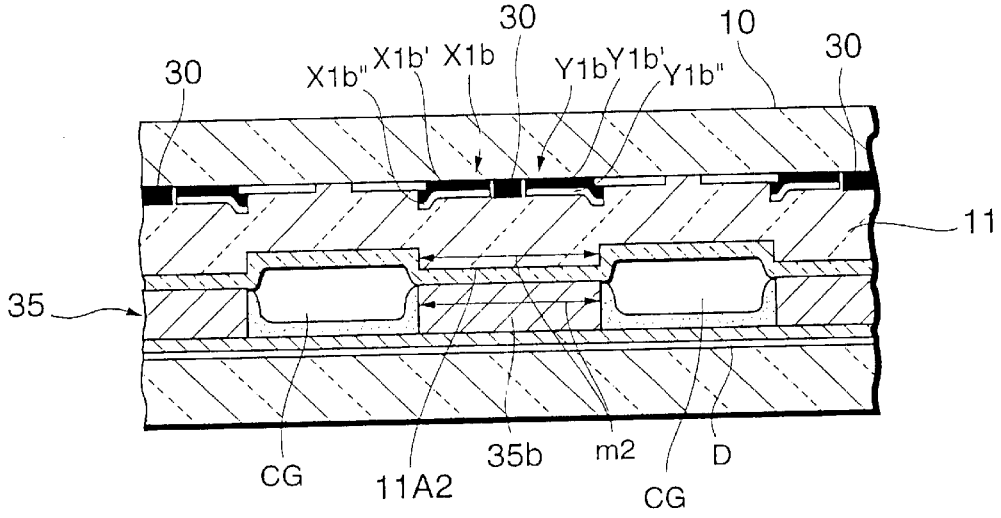
FIG. 12 is a sectional view taken along the V5—V5 line of FIG. 11.
Figure 13:
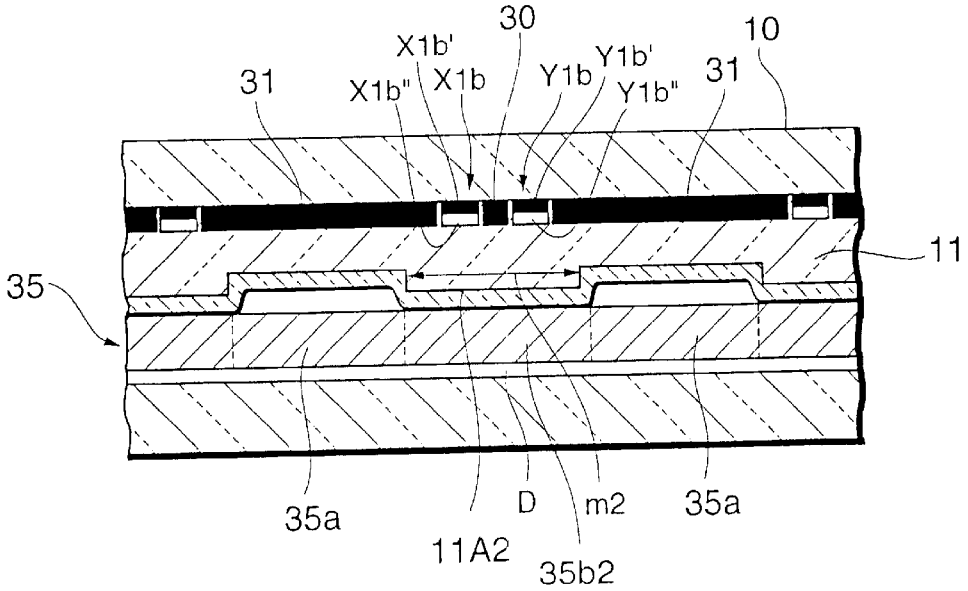
FIG. 13 is a sectional view taken along the V6—V6 line of FIG. 11.
Figure 14:
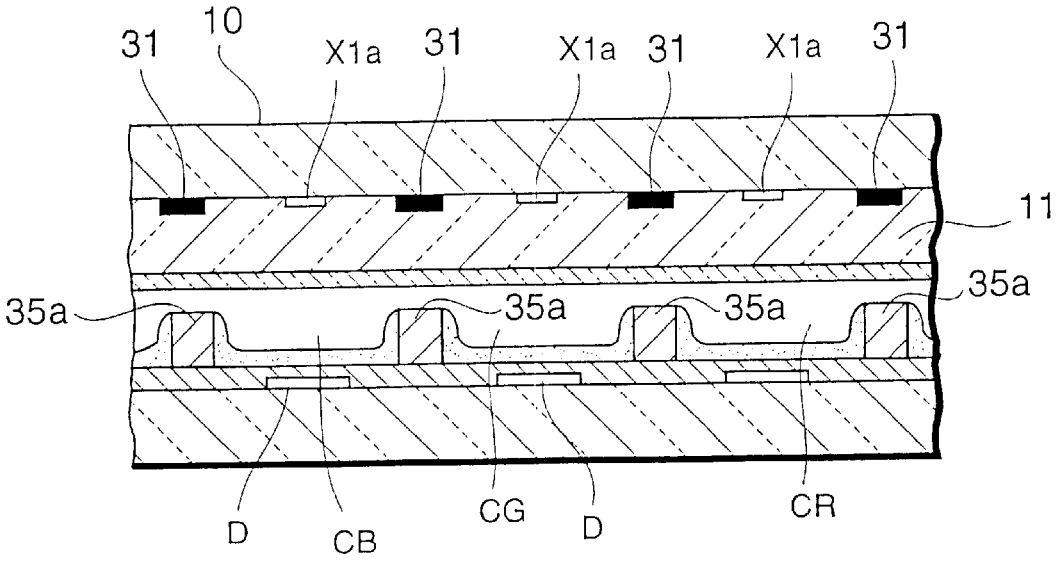
FIG. 14 is a sectional view taken along the W3—W3 line of FIG. 11.
Figure 15:
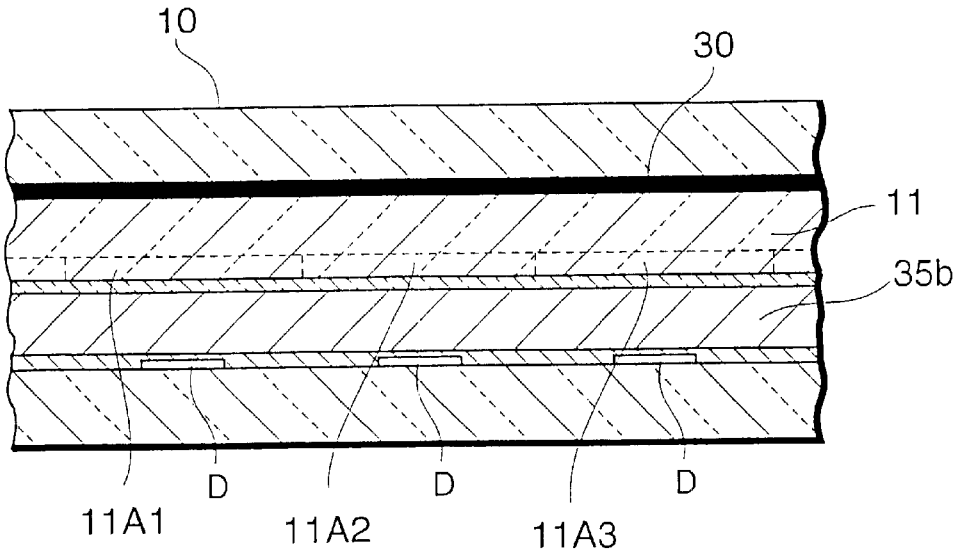
FIG. 15 is a sectional view taken along the W4—W4 line of FIG. 11.

FIG. 11 is a plane view schematically showing a relationship between a row electrode pair and a partition wall of PDP of the fifth example. FIG. 12 is a sectional view taken along the V5—V5 line of FIG. 11. FIG. 13 is a sectional view taken along the V6—V6 line of FIG. 11. FIG. 14 is a sectional view taken along the W3—W3 line of FIG. 11, and FIG. 15 is a sectional view taken along the W4—W4 line of FIG. 11.

In the PDP shown in FIGS. 11 to 15, row electrode pairs (X1, Y1) are arranged on the backside of the front glass substrate 10 in a similar manner to the PDP of the first example of FIGS. 1 to 7.

On the backside of the front glass substrate 10, a black light absorption layer (light-shield layer) 30 is formed between back-to-back oriented bus electrodes **X1*b* and Y1*b* of the respective row electrode pairs (X1, Y1) adjacent to each other in the column direction, to extend along the bus electrodes X1b and Y1b in the row direction, and also a light absorption layer (light-shield layer) 31 is formed at parts facing a vertical wall 35***a* of a parallel-cross shaped partition wall 35.

The partition wall 35 is formed in a white single structure, which is a different point from that of the first example.

The configuration regarding other components is the same as that of the first example, and represented with the same reference numerals as those used in FIGS. 1 to 7.

For the above PDP, portions of the PDP other than portions opposite to the discharge cells CB, CG and CR formed on the backside of the front glass substrate 10 are covered with the light absorption layers (light-shield layers) 30 and 31, and black conductive layers X1*b*' and Y1*b*', of bus electrodes X1*b* and Y1*b* formed in a double layer structure. This prevents reflection of outside light incident from outside through the front glass substrate 10, resulting in improvement in contrast of the display screen.

It should be noted that in the example, only any one of the light absorption layers (light-shield layers) 30 and 31 may be formed.

A color filter layer (not shown) having a color according to each color (blue, green, red) of the phosphor layers formed in the discharge cells CB, CG and CR can be formed on the backside of the front glass substrate 10 to face each discharge cell CB, CG, CR.

In this case, each of the light absorption layers (light-shield layers) 30 and 31 is formed in clearance between the color filter layers formed in an island shape to face each discharge cell CB, CG, CR, or at positions corresponding to the clearance.

As in the PDP of the first example, the PDP in the fifth example is also set such that opening areas SB, SG and SR of the respective discharge cells CB, CG and CR arranged along the display line L from the left hand side in FIG. 11 have a relationship SB>SG>SR.

Specifically, the parallel-cross shaped partition wall 35 is set such that a portion 35*b*1, defining the discharge cell CB, of the transverse wall 35*b* facing the bus electrodes X1*b* and Y1*b* of the respective row electrodes X1 and Y1 oriented back to back in pair has the same width m1 in the column direction (the vertical direction of FIG. 11) as that in the first example; a portion 35*b*2 defining the discharge cell CG has the width m2 in the column direction; and a portion 35*b*3 defining the discharge cell CB has the width m3 in the column direction.

A relationship among the widths m1, m2 and m3 is m2>m3>m1 as in the case of the first example.

Each width r2 extending in the column direction on portions X1*b*2 and Y1*b*2 of the respective bus electrodes X1*b* and Y1*b* adjacent to the discharge cell CG, and each width r3 extending in the column direction on portions X1*b*3 and Y1*b*3 adjacent to the discharge cell CR are set to be larger than each width r1 of portions X1*b*1 and Y1*b*1 adjacent to the discharge cell CB, in accordance with each of the widths m1, m2 and m3 of portions 35*b*1, 35*b*2 and 35*b*3 of the transverse wall 35*b*.

Hence, as in the case of the widths m1, m2 and m3 of the portions 35*b*1, 35*b*2 and 35*b*3 of the transverse wall 35*b*, a relationship among the widths r1, r2 and r3 of the portions X1*b*, X1*b*2 and X1*b*3 of the bus electrode X1*b* and the portions Y1*b*1, Y1*b*2 and Y1*b*3 of the bus electrode Y1*b* is r2>r3>r1, which forms the geometry of pit and projection on each side portion of the bus electrodes X1*b* and Y1*b* oriented toward the discharge cells CB, CG and CR.

Moreover, as in the first example, additional dielectric layers 11A1, 11A2 and 11A3 are formed behind the dielectric layer 11 located on the backside of the front glass substrate 10 to respectively face the portions 35*b*1, 35*b*2 and 35*b*3 of the transverse wall 35*b* of the partition wall 35, and are set to have the same widths as the respective widths m1, m2 and m3 of the portions 35*b*1, 35*b*2 and 35*b*3 of the transverse wall 35 which are opposite to the additional dielectric layers 11A1, 11A2 and 11A3.

It should be noted that the drawings, FIGS. 12 and 13, show only section of the additional dielectric layer 11A2 of the three additional dielectric layers 11A1, 11A2 and 11A3.

As such, any width of each discharge cell CB, CG and CR in the row direction is set to be the same width u. Also, the widths m1, m2 and m3 of the respective portions 35*b*1, 35*b*2 and 35*b*3 of the transverse wall 35*b* defining the corresponding discharge cells CB, CG and CR, have a relationship m2>m3>m1. Hence, a width n1 of the discharge cell CB in the column direction, a width n2 of the discharge cell CG in the column direction, and a width n3 of the discharge cell CR in the column direction have a relationship n1>n3>n2. Furthermore, an opening area SB of the discharge cells CB on the display surface of the front glass substrate 10, an opening area SG of the discharge cells CG and an opening area SR of the discharge cells CR have a relationship SB>SG>SR.

For the above PDP, as in the PDP of the first example, the discharge cell CB formed with a blue phosphor layer having the relatively lowest emission luminance, is formed to have the largest opening area SB; the discharge cell CR formed with a red phosphor layer having a lower emission luminance, is formed to have a larger opening area SR; and the discharge cell CG formed with a green phosphor layer having the relatively highest emission luminance, is formed to have the smallest opening area SG.

Therefore, if an area ratio among the opening areas SB, SG and SR of the respective discharge cells CB, CG and CR is set to relate with a predetermined relative ratio of luminance of blue, green and red, this raises the possibility to, only through controlling the opening area ratio among the discharge cells CB, CG and CR, perform the adjustment of a relative emission luminance among the discharge cells during light emission by the plane discharge which is required for adjustment of white balance.

In consequence, as compared with the conventional method of adjusting the number of times of the discharge to the phosphor layer for each color for adjustment of white balance, since the discharge cell having a higher luminance of the phosphor layer is used as the reference, it is not required to increase the number of times of the discharge in the discharge cell having a lower luminance of the phosphor layer, so that the discharge current is not increased for the adjustment of white balance.

In the other way, since the discharge cell having a lower luminance of the phosphor layer is used as the reference, it is not required to decrease the number of times of the discharge in the discharge cell having a higher luminance of the phosphor layer, so that there may be no reduction in luminance on the screen associated with the adjustment of white balance.

Since the display gradation of each color of the three primary colors becomes stable, the display gradation levels cannot be impaired, resulting in improvement in quality of display screen.

Moreover, since signal conditioning is not needed to adjust the number of times of the discharge in each discharge cell, the driving circuit configuration of PDP can be simple.

It should be noted that in the PDP of the aforementioned example, the width of the vertical wall 35*a* of the partition wall 35 is constant, and the width of the transverse walls 35*b* is varied to allow the opening areas SB, SG and SR of the respective discharge cells CB, CG and CR to differ in size from each other. To differ in size of the opening areas SB, SG and SR of the respective discharge cells CB, CG and CR from each other, the width of the vertical wall 35*a* may also be varied.

Next, a sixth example of the embodiment of the present invention will be described with reference to FIG. 16.

Figure 16:
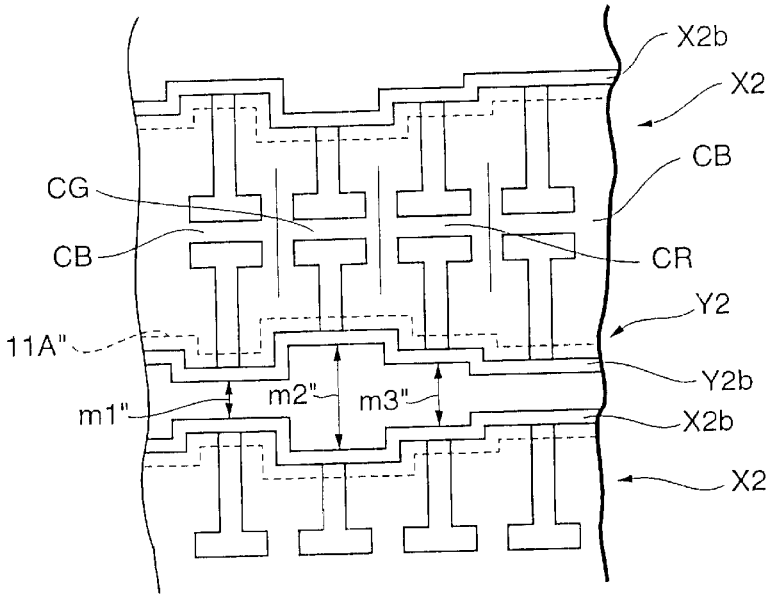
FIG. 16 is a plane view schematically showing a sixth example of an embodiment according to the present invention.

FIG. 16 is a plane view schematically showing a relationship between a bus electrode and an additional dielectric layer of PDP in the sixth example.

The PDP of the aforementioned fifth example has variations in width of the bus electrode of the row electrode pair, in width of the additional dielectric layer corresponding to the bus electrodes and a space between the bus electrodes, and in width of the transverse wall facing the additional dielectric layer for each discharge cell of each color.

However, in the PDP of the sixth example, a bus electrode is constant in width, but a width between back-to-back oriented bus electrodes X2*b* and Y2*b* of row electrode pairs (X2, Y2) arranged in the column direction is varied in accordance with each of the discharge cells CB, CG and CR.

In other words, a relationship among a space m1" of a portion between the back-to-back oriented bus electrodes X2*b* and Y2*b* adjacent to the discharge cell CB, a space m2" of a portion adjacent to the discharge cell CG and a space m3" of a portion adjacent to the discharge cell CR is set to be m2">m3">m1".

Each width of an additional dielectric layer 11A" formed at positions facing the bus electrodes X2*b* and Y2*b* on the backside of the dielectric layer, and of a portion of a transverse wall of a not-shown partition wall relating to each of the discharge cells CB, CG and CR is set as in the case of the fifth example.

As in each case of the aforementioned examples, the PDP of the sixth example is set such that a relationship among the opening areas SB, SG and SR of the respective discharge cells CB, CG and CR is SB>SG>SR, and has function effects similar to those in each example.

Next, a seventh example of the embodiment of the present invention will be described with reference to FIG. 17.

Figure 17:
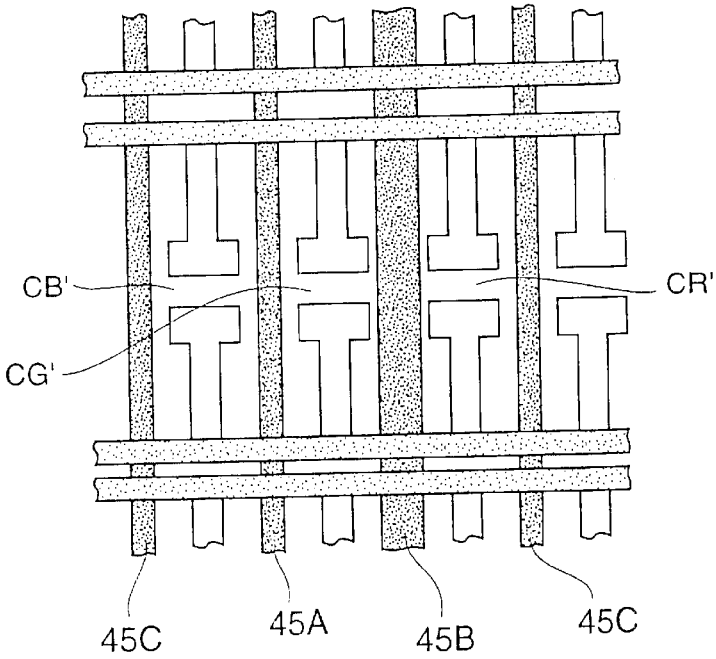
FIG. 17 is a plane view schematically showing a seventh example of an embodiment according to the present invention.

FIG. 17 is a plane view schematically showing a relationship between a bus electrode and an additional dielectric layer of PDP in the seventh example.

Each PDP of the aforementioned first to sixth examples uses the parallel-cross shaped partition wall for defining the discharge cells. In the PDP of the seventh example, however, band-shaped partition walls 45A, 45B and 45C are arranged in parallel in the row direction to define discharge cells CB', CG' and CR' for each color.

In the PDP of the seventh example, the band-shaped partition wall 45B located between the discharge cells CG' and CR' has a larger width than that of the partition walls 45A and 45C, and is positioned closer to the partition wall 45A than to the partition wall 45C.

As a result, a relationship among opening areas of the discharge cells CB', CG' and CR' arranged in the row direction is set to be as in each case of the aforementioned examples, and function effects similar to those of each example are exerted.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a plurality of row electrode pairs extending on a backside of a front substrate in a row direction and arranged thereon in a column direction to form display lines, and a plurality of column electrodes extending in the column direction and arranged in the row direction on a face of a back substrate which is opposite to the front substrate with interposing a space and constituting a discharge cell at each intersecting position with the row electrode pair in the space formed by the back substrate and the front substrate, and phosphor layers in the three primary colors of red, green and blue, respectively, which are respectively formed in a plurality of the resulting discharge cells in order, said plasma display panel comprising:

a partition wall including vertical wall portions arranged between the front substrate and the back substrate to extend in the column direction and transverse wall portions arranged between the front substrate and the back substrate to extend in the row direction, to partition the space between the front substrate and the back substrate into said discharge cells in the row direction and the column direction, wherein each of said transverse wall portions of said partition wall defining said discharge cell formed with said red phosphor layer, said discharge cell formed with said green phosphor layer and said discharge cell formed with said blue phosphor layer is varied in width in the column direction in accordance with each luminance of red, green and blue colors, to set an opening area of a front face of said each discharge cell opposing to said front substrate.

2. The plasma display panel according to claim 1, further comprising:

a dielectric layer formed on a backside of said front substrate to overlay said row electrode pairs, and formed with additional portions at portions thereof facing said transverse wall portions of said partition wall to jut out toward the transverse wall portions, wherein said additional portion is set to vary in width in the column direction in accordance with the width of said transverse wall portion of said partition wall facing the additional portion in the column direction.

3. The plasma display panel according to claim 2, wherein said additional portions is formed on portions of said dielectric layer facing said transverse wall portions to jut out toward the transverse wall portions not to form a space between the additional portion and said transverse wall portion, a space is formed between the additional portion and said vertical wall portion of said partition wall.

4. The plasma display panel according to claim 1, wherein the phosphor layers are formed on side faces of said vertical wall portions and said transverse wall portions of said partition wall and a front surface of the back substrate.

5. The plasma display panel according to claim 1, further comprising:

a light absorption layer formed on a portion of said partition wall opposite to said front substrate.

6. The plasma display panel according to claim 1, comprising:

a light absorption layer formed on a portion between bus electrodes of said row electrodes adjacent to each other in the two display lines.

7. The plasma display panel according to claim 1, wherein each row electrode of said row electrode pair comprises a transparent electrode opposite to the other transparent electrode with interposing a discharge gap in said each discharge cell, and a bus electrode connected to an end of the transparent electrode, locating distance from the discharge gap, said transparent electrode being formed in an independent island state for each discharge cell.

8. The plasma display panel according to claim 1, wherein each of said vertical wall portions of said partition wall defining said discharge cell formed with said red phosphor layer, said discharge cell formed with said green phosphor layer and said discharge cell formed with said blue phosphor layer is equal in width in the row direction to each other.

* * * * *